United States Patent [19]

Killian

[11] Patent Number: 4,729,269

[45] Date of Patent: Mar. 8, 1988

[54] POWERED PIPE WRENCH

[76] Inventor: Richard H. Killian, 3053 Forbes Ave., Santa Clara, Calif. 95051

[21] Appl. No.: 922,427

[22] Filed: Oct. 23, 1986

Related U.S. Application Data

[63] Continuation of Ser. No. 794,461, Nov. 4, 1985, abandoned.

[51] Int. Cl.[4] ..... B25B 21/00

[52] U.S. Cl. ..... 81/57.11; 81/57.15; 81/57.21; 81/58.1

[58] Field of Search ..... 81/57.13–57.15, 81/57.2, 57.3, 57.11, 57.46, 57.33, 170, 57.21, 58.1

[56] References Cited

U.S. PATENT DOCUMENTS

| | | | |
|---|---|---|---|
| 2,687,662 | 8/1954 | Pugh | 81/170 X |
| 3,521,509 | 7/1970 | Duke et al. | 81/57.15 |
| 3,939,924 | 2/1976 | Grabovac | 81/58.1 X |
| 3,988,952 | 11/1976 | Dirks | 81/57.21 X |
| 4,381,685 | 5/1983 | Brooks | 81/57.13 |

*Primary Examiner*—Debra Meislin

*Attorney, Agent, or Firm*—George W. Wasson

[57] ABSTRACT

A pipe wrenching tool adapted to be powered by a hand held power drive mechanism is formed with a support for a drive wheel and an idler wheel with the idler wheel being movable with respect to the drive wheel to adjust the tool for differing sizes of pipe. The tool is adapted to interface transversely to the axis of the pipe to be wrenched with the drive wheel engaging the pipe without requiring a part of the tool to circumscribe the pipe. The rotational axis of the idler wheel and rotational axis of the drive wheel are off-set with respect to each other to cause the pipe being wrenched to be forced into the tool. The tool is adapted at both sides to have the drive source attached at the side of the tool away from the pipe so that the tool may be used to engage and wrench pipe in confined spaces. Only the wheels of the tool are rotated; the tool need not rotate with respect to the pipe.

12 Claims, 8 Drawing Figures

POWERED PIPE WRENCH

This application is a continuation of application Ser. No. 794,461, filed Nov. 4, 1985, now abandoned.

FIELD OF THE INVENTION

This invention relates to tools and more particularly to a pipe joint make-up and break-out tool for quick making or breaking of threaded pipe joints. Throughout this specification and the claims the tool will be referred to as a pipe wrenching tool.

BACKGROUND OF THE INVENTION

The making and breaking of threaded pipe joints has generally been a hand operation requiring the use of one or more pipe wrenches. The use of pipe wrenches requires that there be adequate space around the axis of the pipe to permit the wrench to be rotated with the pipe. Such space is usually available in making subassemblies and in completing a piping or plumbing job before the piping is enclosed within, under or behind a wall or floor.

There are powered pipe make-up and break-out tools that are used where there is adequate room for the tools and the pipe; such tools are frequently used to make joints in pipe subassemblies that are later installed in a finished piping or plumbing job. The use of such powered tools is limited to the availability of space for the tool to contact and rotate the pipe and use of such powered tools has been unknown where space is extremely limited.

The need for a powered pipe make-up and break-out tool is not solely based on a labor saving principle of reducing the amount of hand energy that must be used to make or break a pipe joint. There has developed a need for a tool that may be used where extremely limited space is available for the rotation of a pipe or coupling, such rotation being essential to the make-up or break-out of a joint or section of threaded pipe.

In some powered pipe rotating tools it is necessary that one or more elements of the tool wholly or at least partially circumscribe the pipe; that is, wrap around or partially around the pipe. The space limitation that prevents the use of such powered pipe rotating tools is not just the space at either side and parallel to the pipe but also includes the space behind the pipe if the powered tool requires that a portion of the tool circumscribe the pipe. With the powered pipe wrenching tool of the present invention the pipe is contacted from a direction transverse to the pipe without requiring that an element of the tool be fastened or wrapped around the pipe.

The most pertinent prior art is typified by U.S. Pat. No. 4,381,685 issued May 3, 1983 to M. O. Brooks. In that patent a pipe clamping means in the form of a C-shaped with two spaced idler wheels is disclosed with torquing means provided by a powered rotating drum. The C-shaped clamping means must circumscribe the pipe. That patent, and others like it, are adapted to be used in making and breaking pipe joints, as for instance well pipes, in a work area where adequate space is available to clamp around the pipe.

The powered pipe wrenching tool of the present invention is intended to be usable in the space limited environment described above as well as anywhere that pipe is rotated or wrenched to make or break a joint or coupling. A substantial advantage in the use of the powered pipe wrenching tool of the present invention comes in the use of the tool where space is so limited that rotation of a pipe with a conventional pipe wrench would be substantially impossible because the wrench could not be moved after it was secured to the pipe. The tool is useful in any pipe rotating operation where powered pipe make-up or break-out would be advantageous. If the powered pipe wrench of the present invention can be contacted with the pipe, there will be adequate space for the powered tool to rotate the pipe. The powered pipe wrenching tool can be a labor saving device, a more efficient tool than the use of hand wrenching operations and an essential tool where space limitations are present.

An object of the present invention is to provide a powered pipe wrenching tool that is adapted for quick interfacing to pipe in general and particularly to pipe located in close proximity to a wall or other barrier.

Another object of the present invention in accord with the preceding object is a powered pipe wrenching tool that avoids circumscription of the tool around the pipe it interfaces.

A further object of the present invention in accord with the preceding objects is a powered pipe wrenching tool that provides easy interfacing to pipe with convenient adjustment means for adapting the tool to varying sizes of pipe.

A further object of the present invention in accord with the preceding objects is a powered pipe wrenching tool that is adapted to have its power source connected to either side of the tool with the rotating elements of the tool adapted for rotation in either direction.

Another object of the present invention in accord with the preceding objects is a powered pipe wrenching tool wherein the tool is easily interfaced with a pipe to be rotated and the drive mechanism of the tool forces the pipe toward the idler wheel of the tool so as to enhance the contact of the drive mechanism with the pipe.

Further objects and features of the invention will be readily apparent to those skilled in the art from the appended drawings and specification illustrating preferred embodiments wherein:

DESCRIPTION OF PREFERRED EMBODIMENTS

Figure 1:
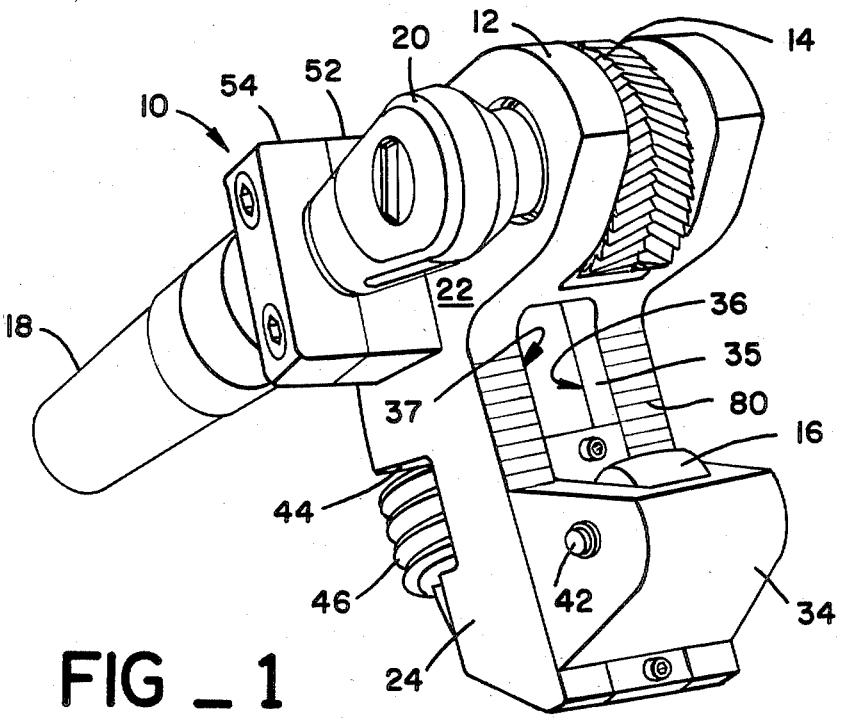
FIG. 1 is a perspective view of the powered pipe wrenching tool of the present invention.

The powered pipe wrenching tool 10 of the present invention is illustrated in FIG. 1 in its assembled form as it might be used to power wrench piping. The tool itself comprises a two sided frame 12, a drive wheel 14, an idler wheel 16 with portions of the frame adapted to support the wheels. The power source 18 is shown as a conventional power drive that is commercially available in either electrical or pneumatic power form. Neither the power source nor its form is a limiting element of the invention; the power source provides powered rotary force at its head 20 for drive of the drive wheel 14 as will be described.

Figure 2:
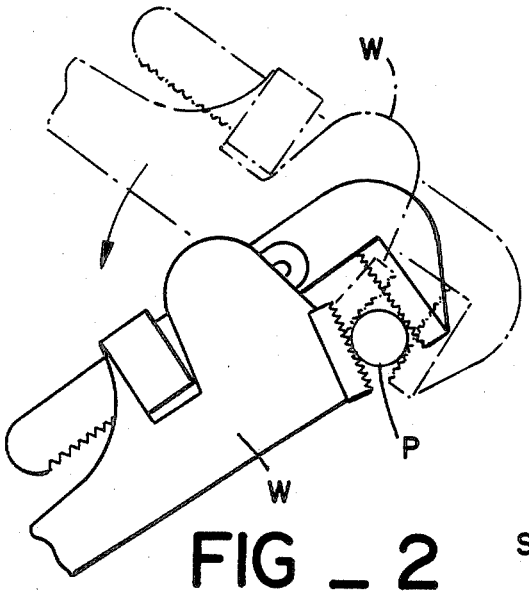
FIG. 2 is an illustration of the prior art use of a hand pipe wrench for rotating pipe illustrating the need for space to rotate the wrench.

FIG. 2 illustrates a conventional hand tool, known as a pipe wrench, as it would be used to rotate a threaded pipe in a make-up or break-out operation. This figure is intended to illustrate that the wrench W starting from its position shown in phantom must be rotated counterclockwise to its position shown in full lines to accomplish rotation of the pipe W. Note that the wrench must circumscribe the pipe W to make a firm grip on the pipe and that the extended handle (not shown) as well as the jaw portion of the wrench must have adequate operating room for the wrench to accomplish any rotation of the pipe P.

Figure 3:
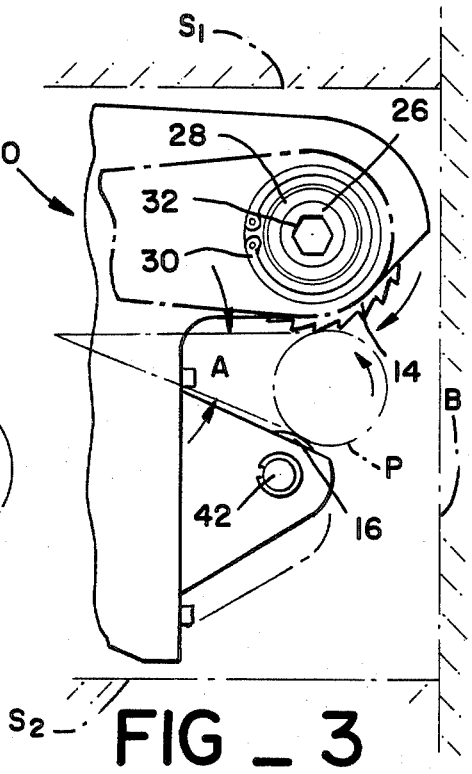
FIG. 3 is an illustration of the operating head of the powered pipe wrenching tool of the present invention showing the limited space that is needed to permit use of the tool.

FIG. 3 illustrates the frame portion only on the powered pipe wrenching tool 10 of the present invention in its operating relationship with a pipe P and illustrates the limited space that is needed for the tool to accomplish rotation of the pipe P. As illustrated, the pipe P may be located between studs $S_1$ and $S_2$ and in close proximity to a barrier B behind the pipe. The tool 10 will still be able to engage the pipe P and will be able to rotate the pipe without requiring the space that would be required if the wrench of FIG. 2 were used.

As illustrated in FIGS. 1, 4, 5 and 6, the two sided frame 12 of the tool 10 is preferrably formed, cast or machined from a unitary body and is generally open-faced L-shaped with a leg portion 22 and an upright portion 24. In the drawings the L-shape is inverted with the leg of the L above the upright portion. For the purposes of description of the tool and its construction, the portion or face of the tool that is intended to engage the pipe is referred to as the outside of the tool and the portion or face that is toward the user and the power drive is referred to as the inside of the tool.

The leg portion 22 has a central cut-out portion that provides supporting sides 23 and 25 for support of the drive wheel 14. The drive wheel 14 is press fit or keyed to a shaft 26 and the shaft is rotatably supported in suitable bearings 28 retained by retainer rings 30 in the supporting sides 23 and 25. Shaft 26 has an interior drive formation 32, here shown as a hexagonal socket, for engagement with a mating drive element of the power drive mechanism as will be described later.

The upright portion 24 also has a central cut-out portion that provides support and a movement guide for the rotational support of the idler wheel 16. The idler wheel 16 is rotatably supported on a movable idler wheel support 34. The central cut-out portion has an inner circular cut-out form at 36 terminating in parallel outer guide faces at 35 and 37. The movable idler wheel support 34 is supported on a cylinderical barrel 38 which is movable within the inner circular cut-out 36. The idler wheel is rotatably supported on needle bearings 40 and press fit onto a shaft 42 that is supported in holes in the support 34. The shaft is retained by suitable retainers such as spring clips at 39. The idler wheel 16 is slightly crowned to distribute the pressure on the wheel across the bearings 40 and to assist in aligning the drive wheel in its contact with the pipe that is to be rotated.

The outer edge of the inside of the upright portion of the tool, near the connection with the power source, has a transverse cut-out portion 44 that opens that side of the tool to the inner circular cut-out 36. In the cut-out 44 a worm gear 46 is rotatably supported on a shaft 48 suitably fixed in the outer edge of the tool. The cylinderical barrel 38 has a set of rack gear teeth 50 cut into its surface facing the worm gear 46. The worm gear 46 and rack gear teeth provide for lateral movement of the barrel within the cylindrical cut-out 36 and thus provide for positioning of the idler wheel 16 with respect to the drive wheel 14. The idler wheel support 34 is fixed by suitable means to the cylinderical barrel 38.

Figure 4:
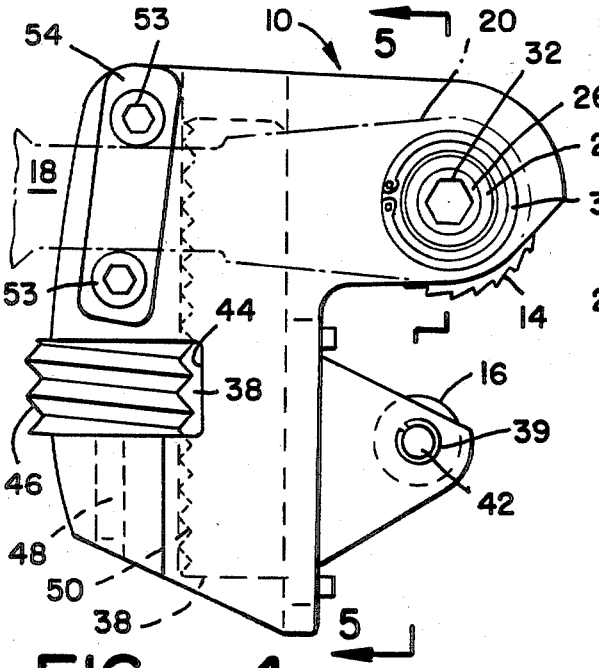
FIG. 4 is a side elevational view of the powered pipe wrenching tool.
Figure 5:
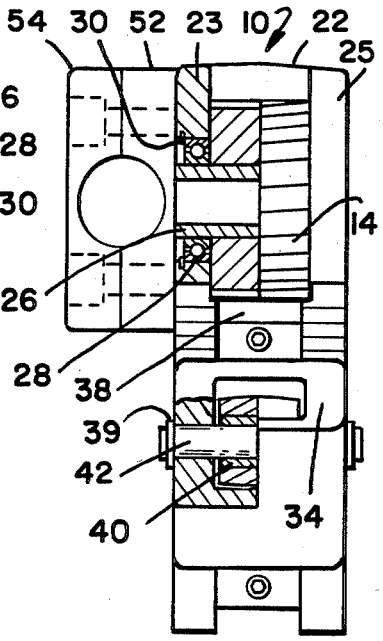
FIG. 5 is a front elevational view partially in section along the line 5—5 of the powered pipe wrenching tool of FIG. 4
Figure 6:
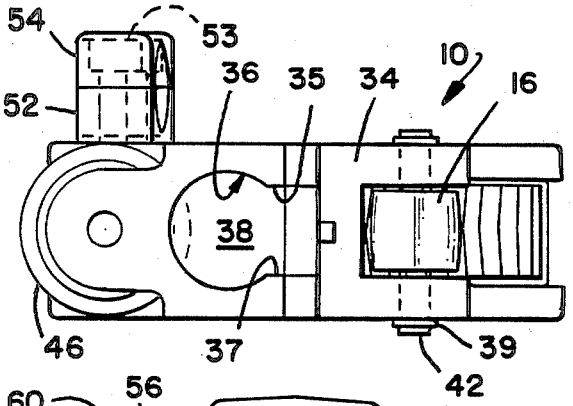
FIG. 6 is a bottom view of the powered pipe wrenching tool of FIG. 4.

As shown in FIG. 1 and in phantom in FIG.4 the power drive source 18 is supported on one side of the tool in a clamping mechanism including mating elements 52 and 54 adapted to cooperate with mounting bolts 53 that thread into threaded holes 55 in the sides of the tool. Both sides of the tool of the present invention are provided with the threaded holes so that the power drive source may be mounted on either side of the tool.

Figure 7:
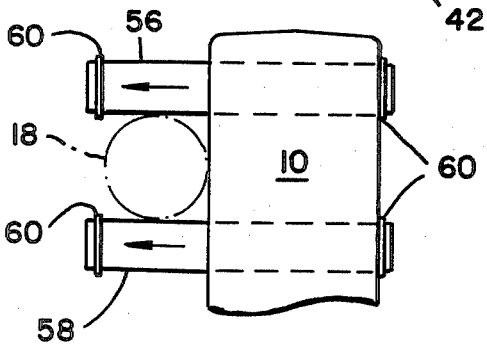
FIG. 7 and FIG. 8 are elevational views of the rear of the tool illustrating an alternative mounting arrangement for attaching a power source to the tool of the present invention.
Figure 8:
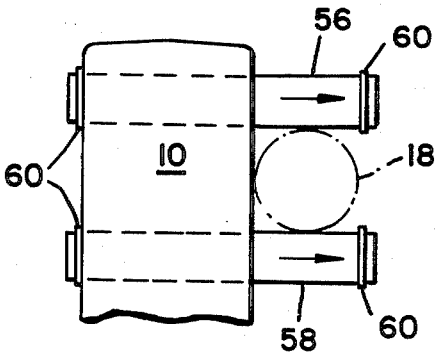

An alternative form of mounting means is shown in FIG. 7 and FIG. 8 where pins 56 and 58 are slideably supported in holes that pass entirely through the tool. The pins are spaced to accomodate the neck of a power drive source that may be placed between the pins. The pins are provided with circumferential grooves at each end for cooperation with a set of spring clips 60 to operate as "keepers" for holding the pins in the tool.

The operation of the tool should be readily apparent from the foregoing description of the elements and formation of the tool. The tool is preferably formed in one piece except for the rotating and sliding elements. The one piece form provides integrity and strength to the tool. In use the tool is first set or adjusted to the size of pipe that is expected to be rotated in the make-up or break-out operation by rotation of the worm gear 46 on the inside face of the frame. Rotation of the worm gear 46 causes lateral movement of the idler wheel support 34. The tool is then pressed against the pipe with the drive wheel 14 engaging the pipe so as to pull the tool into the pipe and jamb the serrated drive wheel surface tight against the pipe and toward the idler wheel 16 when the drive wheel 14 is rotated. Suitable scale markings 80 are provided along the outside face of the frame for use in setting the idler wheel 16 to an appropriate position. The tool does not circumscribe the pipe and therefore may be quickly applied, even in tight places.

The power drive source is preferrably formed with a suitable socket form that will mate with the drive socket formation 32 and the drive source is set to rotate the drive wheel in a direction that will force the pipe toward the throat of the gap between the idler wheel and drive wheel. A conventional power source rotation directional control setting lever is illustrated at 70 in FIG. 1 at the rotational drive head 20 of the tool 10.

The preferred setting of the space between the drive wheel and the idler wheel is such that the imaginary tangent line drawn at the interface of the pipe and drive wheel and the imaginary tangent line drawn at the interface of the pipe and idler wheel will intersect and form a sharp angle compatable with the coefficient of friction between the pipe and the drive wheel. As is illustrated in FIG. 3, the angle A (greatly exaggerated) is preferrably less than 10 degrees to accomplish the desired frictional engagement between the pipe and drive wheel. With the angle A less than 10 degrees the drive wheel 14 will not slip regardless of the magnitude of the torque applied from the power source. The face of the drive wheel 14 is provided with herringbone serrations as an assist in transferring the rotation of the wheel to the pipe to be rotated and the face of the idler wheel 16 is slightly crowned to allow the drive wheel to seat squarely on the pipe and to accomplish uniform distribution of the force on the idler wheel to its bearings.

The alternative form for mounting the power drive source to the tool 10 illustrated in FIGS. 7 and 8 provides for capturing the neck of the power source between the two slideable pins 56 and 58. As illustrated, the pins may be positioned at either side of the tool 10 to permit the source to be located at either side. With a reversible directional drive in the power source, the tool 10 may be driven from either side and the direction of rotation of the drive wheel 14 may be appropriate to either make-up or break-out a threaded pipe joint.

The foregoing description and drawings illustrate a pipe wrenching tool that is adapted to be powered by a hand held power drive mechanism for rotating threaded pipe in a clockwise or counterclockwise direction. The tool comprises a two sided frame for supporting a drive wheel to be driven by the power drive mechanism and an idler wheel. The drive wheel is rotatably supported in the frame of the tool and the idler wheel is movably positioned with respect to the drive wheel and rotatably supported in its movable support. The frame of the tool is adapted to have the power drive mechanism mounted on either side of the frame in either a clamping mechanism or between a pair of slideable pins. The tool is adapted to engage the pipe it is to rotate in a transverse direction and to be held stationary on the pipe as the drive wheel rotates the pipe with respect to the tool. The tool has only the two wheels (drive and idler) engaging the pipe and those two wheels are in contact with and drive the pipe without circumscribing the pipe. Easily accessible adjustment means are provided at the inside face of the tool to set the tool for different sizes of pipe. The drive wheel and idler wheel of the tool have their rotational axes slightly offset from each other so as to cause the pipe to be jambed into the face of the tool when the drive wheel is rotated. The drive wheel is serrated to accomplish a firm contact with the pipe and, with proper spacing of the drive wheel and the idler wheel for the pipe size being rotated, the drive wheel will not slip against the pipe regardless of the torque applied with the power source.

It should be noted, as shown in FIGS. 3 and 4, that the rotational axis of the drive wheel and the rotational axis of the idler wheel are parallel but that the idler wheel axis is movable in a plane off-set from the plane including the axis of drive wheel. The idler wheel axis is off-set toward the frame of the tool to insure that a pipe being rotated between the two wheels is forced into the throat of the tool. Further, with proper positioning of the idler wheel with respect to the drive wheel, the relationship between the pipe and the drive wheel will be compatable with the coefficient of friction of the pipe and wheel. In a preferred adjustment of the distance between the idler wheel and the drive wheel for a particular size of pipe the angle between the imaginary tangent line of the pipe and idler wheel and the imaginary tangent line of the pipe and drive wheel will be less than ten degrees.

While certain preferred embodiments of the invention have been specifically disclosed, it should be understood that the invention is not limited thereto as many variations will be readily apparent to those skilled in the art and the invention is to be given its broadest possible interpertation within the terms of the following claims.

I claim:

1. A pipe wrenching tool adapted to be powered by a hand held power drive mechanism for rotating threaded pipe in clockwise or counterclockwise direction, said tool having an outside pipe engaging edge and a power drive mechanism attachment edge, said tool comprising, (a) a two sided, unitary body frame, said frame having an open face at said outside pipe engaging edge thereof and an inside face at said drive mechanism edge thereof, (b) a drive wheel, (c) an idler wheel, (d) means in said frame for rotatably supporting said drive wheel inbetween said two sides thereof in a manner to expose said drive wheel at said open face of said frame, (e) means in said frame for rotatably supporting said idler wheel inbetween said two sides thereof in a manner to expose said idler wheel at said open face of said frame, said means including means for movably positioning said idler wheel with respect to said drive wheel, (f) means at both sides of said frame for rotating said drive wheel in said rotatable support, (g) supporting means for supporting a power drive mechanism on said frame with said drive mechanism in mechanical engagement with one of said means for rotating said drive wheel, said drive mechanism extending from one of said sides and away from said inside face of said frame, (h) and each side of said frame including means for mounting said supporting means thereto such that said supporting means selectively extends from one or the other of said sides.

2. The pipe wrenching tool of claim 1 wherein said frame is opened-faced L-shaped so as to engage said pipe to be rotated transversly to the axis of said pipe in said opened face of said frame.

3. The pipe wrenching tool of claim 2 wherein said means for positioning said idler wheel is accessible from the inner surface of said inside face of said L-shaped frame.

4. A pipe wrenching tool adapted to be powered by a hand held power drive mechanism for rotating threaded pipe about the axis of said pipe in clockwise or counterclockwise direction comprising, (a) a two sided frame, said frame having duplicate side surfaces at each side thereof, said frame being an opened-faced L-shaped construction in cross-section parallel to said sides and having a leg portion and an upright portion at said opened face, (i) said leg portion and said upright portion defining an opened faced outer surface of said frame, (ii) the side of said upright portion opposite to said leg portion defining an inner surface of said frame, (iii) and said frame being adapted to engage said pipe to be rotated transversly to the axis of said pipe in said opened face outer surface of said frame, (b) a drive wheel, (c) an idler wheel, (d) said drive wheel being rotatably supported in said leg portion of said frame at said opened face, (e) said idler wheel being rotatably supported in said upright portion of said frame at said opened face and being movably positionable along said outer surface of said frame at said upright portion to position said idler wheel with respect to said drive wheel, (f) means in said inner surface at said upright portion of said frame for positioning said idler wheel along said outer surface of said frame with respect to said drive wheel, (g) means at both sides of said frame for rotating said drive wheel in said rotatable support, (h) supporting means for selectively supporting a power drive mechanism at either of both sides of said frame with said drive mechanism in mechanical engagement with one of said means for rotating said drive wheel, (i) and each side of said frame including means for mounting said supporting means thereto such that said supporting means selectively extends from one or the other of said sides.

5. The pipe wrenching tool of claim 4 wherein the rotational axis of said means for rotatably supporting said drive wheel and the rotational axis of said means rotatably supporting said idler wheel are parallel, said idler wheel axis being movable in a plane off-set from the plane including said drive wheel, said off-set of said idler wheel axis being toward said frame with respect to the axis of said drive wheel, said movable positioning of said idler wheel with respect to said drive wheel being adapted to establish an angle of less than ten degrees between the intersection of a first imaginary tangent line at the interface of said idler wheel and a pipe being held and rotated between said drive wheel and said idler wheel and a second imaginary tangent line at the interface of said drive wheel and said pipe being held and rotated between said drive wheel and said idler wheel, whereby the drive from said drive wheel to said held and rotated pipe will be compatible with the coefficient of friction between said drive wheel and said pipe.

6. The pipe wrenching tool of claim 4 wherein said supporting means for supporting said drive mechanism includes means (a) for positioning said drive mechanism for mechanical engagement with said means rotatably supporting said drive wheel, and (b) for preventing rotary movement between said drive mechanism and said frame.

7. The pipe wrenching tool of claim 6 wherein said supporting means for supporting said drive mechanism is a clamping mechanical support for said power mechanism.

8. The pipe wrenching tool of claim 6 wherein said supporting means for supporting said drive mechanism is a set of pins movable transversely of said frame to extend beyond the surface of said frame at either of both sides thereof.

9. The pipe wrenching tool of claim 4 wherein said drive wheel has a serrated outer surface in a herring bone pattern.

10. The pipe wrenching tool of claim 4 wherein said idler wheel is crowned to maintain a substantially point contact with pipe being rotated between said drive wheel and said idler wheel.

11. The pipe wrenching tool of claim 4 wherein said means for rotatably supporting and movably positioning said idler wheel includes (a) a portion for supporting said idler wheel, said portion including a surface having a rack gear surface, (b) a worm gear rotatably supported in said upright portion of said L-shaped frame, said worm gear being in mechanical contact with said rack gear, (c) whereby rotation of said worm gear causes lateral movement of said portion supporting said idler wheel toward or away from said drive wheel.

12. The pipe wrenching tool of claim 11 wherein said worm gear is accessible from the inside of said upright portion of said L-shaped frame.

* * * * *